US006123435A

United States Patent [19]

Wang

[11] Patent Number: 6,123,435

[45] Date of Patent: Sep. 26, 2000

[54] SHEET METAL HOUSING FOR AN HID LUMINAIRE

[75] Inventor: James P. Wang, Blacksburg, Va.

[73] Assignee: Hubbell Incorporated, Orange, Conn.

[21] Appl. No.: 09/090,068

[22] Filed: Jun. 3, 1998

[51] Int. Cl.[7] ..... F21K 2/00

[52] U.S. Cl. ..... 362/263; 362/263; 362/265; 362/294; 362/368; 362/147

[58] Field of Search ..... 362/263, 265, 362/294, 147, 368, 370, 373; 361/674; 174/DIG. 2

[56] References Cited

U.S. PATENT DOCUMENTS 4,729,740 3/1988 Crowe et al. ..... 439/76
5,276,599 1/1994 Neely ..... 362/301

*Primary Examiner*—Sandra O'Shea
*Assistant Examiner*—Bertrand Zeade
*Attorney, Agent, or Firm*—Jerry M. Presson; William C. Roch

[57] ABSTRACT

A sheet metal housing for an HID luminaire which comprises a two piece, fold-up sheet metal housing which provides exceptional strength with minimal usage of materials to support a very heavy ballast therein. The sheet metal housing is suitable for a low cost highbay luminaire with high watt ballasts for Metal Halide and High Pressure Sodium, Mercury Vapor (HID) light sources. The sheet metal housing provides reflector adjustability for different size lamps and light centers. A top sheet metal stamping defines a central ballast shelf on which a ballast is mounted, and first and second ends of the top stamping are bent 90° on opposite sides of the central ballast shelf. The first and second ends of the top stamping are further bent back 180° upon themselves to form a double wall. The first and second ends of the top stamping are further bent 90° to project towards each other. The very ends of the first and second ends of the top stamping are further bent and interconnected to form a three wall top hanging system, and to form a top sheet metal housing. First and second ends of a bottom sheet metal stamping are bent 90° about a central section to form a bottom sheet metal housing.

12 Claims, 4 Drawing Sheets

SHEET METAL HOUSING FOR AN HID LUMINAIRE

BACKGROUND OF THE INVENTION

Field of the Invention

The present invention relates generally to a sheet metal housing for an HID luminaire, and more particularly pertains to a sheet metal housing for an HID luminaire which comprises a two piece, fold-up sheet metal housing which provides exceptional strength with minimal usage of materials to support a very heavy ballast therein.

SUMMARY OF THE INVENTION

Accordingly, it is a primary object of the present invention to provide a sheet metal housing for an HID luminaire.

A further object of the subject invention is the provision of a sheet metal housing which is suitable for a low cost highbay luminaire with high watt ballasts for Metal Halide and High Pressure Sodium and Mercury Vapor light sources. The sheet metal housing for the two different light source technologies provides reflector adjustability for different size lamps and light centers.

In accordance with the teachings herein, the present invention provides a two piece, fold-up sheet metal housing for a luminaire which provides strength with minimal usage of materials to support a heavy ballast. A top sheet metal stamping defines a central ballast shelf on which a ballast is mounted, and first and second ends of the top stamping are bent 90° on opposite sides of the central ballast shelf. The first and second ends of the top stamping are further bent back 180° upon themselves to form a double wall. The first and second ends of the top stamping are further bent 90° to project towards each other. The very end of the first end of the top stamping is further bent 90° to form a first wall of a top wall hanging system. The second end of the top stamping is further bent 90° to form a second wall of the top wall hanging system, and is further bent 180° back upon itself while encompassing the first wall hanger to form a third wall of the top wall hanging system, to form a top sheet metal housing.

First and second ends of a bottom sheet metal stamping are bent 90° about a central section to form a bottom sheet metal housing. The bottom sheet metal housing is secured to the top sheet metal housing to form an assembled sheet metal housing for the luminaire in a rigid monocoque design.

In greater detail, a heat shield is formed along one end of the central ballast shelf, which is bent 90° relative to the central ballast shelf to form a heat shield adjacent to the central ballast. The heat shield separates the hot ballast from a capacitor, starter and wiring compartment.

The ballast is secured to the central ballast shelf by mounting fasteners, such as bolts, screws, rivets, etc. which extend through holes in the central ballast shelf into mounting holes in the core of the ballast, such that the rigidity of the ballast core reinforces the top housing. The central ballast shelf defines a central ballast mounting hole which allows coils of the ballast to project therethrough, to allow the ballast core to rest directly against the central ballast shelf. Clearance holes are also provided in the central ballast shelf to provide clearance for fastener (bolt) heads which extend from the ballast into the mounting shelf.

The ballast shelf is mounted with a wireway duct being defined below the mounted ballast. The ballast is mounted offset in the top sheet metal housing with the ballast steel core in close proximity to three sides of the upper housing, such that the close proximity of the ballast to the three walls assists in the transfer of heat directly from the ballast to the housing to increase the surface area available for cooling.

Vent holes are provided in a lower portion of two end panels of the bottom housing to draw air into the housing over the capacitor and ballast, and vent holes are also provided in a top portion of front and rear panels of the top housing to provide for venting of the hot air.

A lamp socket is mounted to the bottom housing with the wires thereto running under the ballast coil into the capacitor compartment.

The capacitor is mounted on a capacitor end panel of the bottom housing by a metal strap. A first end of the metal strap is inserted into and secured in a recess, and a second end of the strap is secured by a screw to a hole in the capacitor panel.

BRIEF DESCRIPTION OF THE DRAWINGS

The foregoing objects and advantages of the present invention for a sheet metal housing for an HID luminaire may be more readily understood by one skilled in the art with reference being had to the detailed description of several preferred embodiments thereof, taken in conjunction with the accompanying drawings wherein like elements are designated by identical reference numerals throughout the several views, and in which.

DETAILED DESCRIPTION OF THE DRAWINGS

The present invention provides a design for a low cost highbay luminaire for 400 watt Metal Halide and High Pressure Sodium light sources. It uniquely addresses a number of very difficult challenges.

1. The core and coil ballast and capacitor can weigh more than 13 pounds, and together comprise more than 65% of the target cost. It is extremely difficult to select and balance the appropriate housing material, fabrication, assembly and packaging considerations to meet the structural, aesthetic, quality, safety, functional, cost and installation criteria of a suitable housing for an HID luminaire.

2. Thermal considerations also pose formidable barriers to a low cost solution by adding costs to the product in terms of the enclosure size and material type and thickness.
3. Optical performance and the offering and availability of multiple different light source technologies require reflector and/or socket adjustability for different size lamps and light centers which also add complexity and cost.
4. Due to the high component weight, packaging is usually a major cost component. Low cost enclosure solutions typically result in a weak design due to cost pressures, and have to be compensated for with expensive packaging or by accepting high warranty costs. A strong, resilient, yet inexpensive design is paramount in holding down packaging, transit and warranty costs.

In order to address these intrinsic problems, a design strategy was devised to address the different considerations as inter-dependent parameters. The material selections, fabrication techniques, and mounting design details all worked in concert with each other to optimize the solution as a total entity. This allowed trade offs and compromises during the development cycle which resulted in a product which exceeded expectations from cost, manufacturing, assembly, distribution and customer points of view. Although one particular product was designed for 400 watt HID ballasts, the design can easily be adapted to any size ballast.

The resultant housing design consists of two (top and bottom), perforation-scored, fold-up stampings which are folded to form respectively top and bottom housing enclosures, which are then assembled as one unitary housing. The two stampings are made of sheet metal such as thin gauge, prepainted or postpainted, or galvanized steel sheet metal, a very inexpensive and readily available material.

Figure 9:
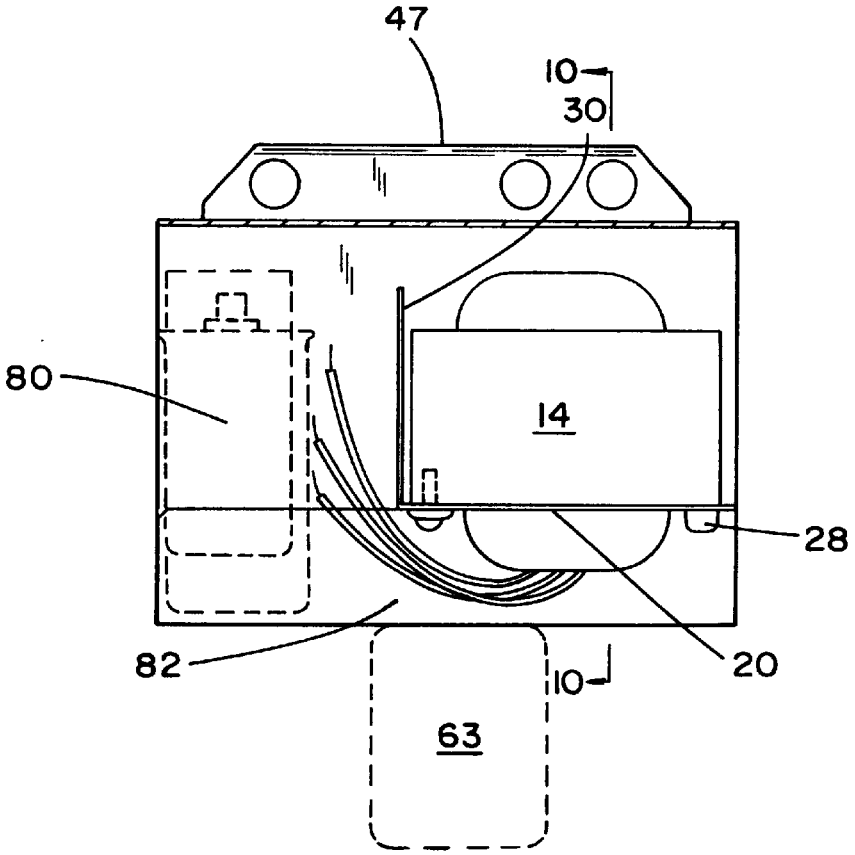
FIG. 9 is a sectional view of the housing assembly taken along directional arrows 9—9 in FIG. 10.
Figure 10:
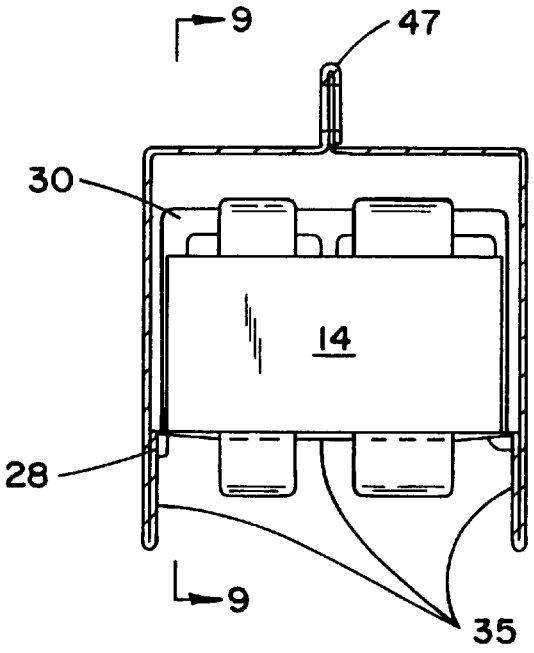
FIG. 10 is a sectional view of the housing assembly taken along directional arrows 10—10 in FIG. 9.

This material strategy allows for low cost parts, but is inherently weak, flimsy and appears cheap. In order to overcome these negative traits, an offset, suspended ballast mounting was developed which places the steel core of the ballast as close as possible to three sides of the housing, as illustrated in FIGS. 9 and 10. The orientation and placement of the ballast on an internal mounting shelf are crucial aspects of the design and are key to the success of the design.

Instead of attempting to contain and hold the ballast, this design uses the rigidity of the ballast core to reinforce the housing. The entire design is premised on the concept of mutually reinforcing structures. Structural integrity was further enhanced by using the sheet metal walls in concert with the ballast in tension or in compression, and by utilizing right angle geometry. This allows the use of a thinner gauge steel sheet metal to reduce costs.

The resultant design is a unique double wall, fold-back mounting system with an open center shelf which directly mounts the ballast core by two diagonally opposed fasteners such as bolts, screws, rivets, etc. into the core. These bolts prevent the ballast from moving and are only structurally stressed while packaged. Once the luminaire is installed, the majority of the forces needed to support the ballast are born by the housing mounting system. All of the weight is transferred directly to the double wall, fold-back panels. This eliminates the requirement for a mounting bracket or through bolt, washer and nut mounting systems. By supporting the ballast in this manner, UL required electrical clearances for the ballast coils are achieved, and a wireway area is also provided for the ballast and socket wires. The offset placement of the ballast permits easy wiring and access from one side.

An extended portion of the ballast shelf is folded up to form a heat shield to separate the starter and capacitor from the hot ballast. This integrated heat shield also provides a fastening surface for the ground wire and optional heat barrier, in addition to adding considerable strength to the housing. It also eliminates the necessity for special edge treatment for the wireway below the shield, as is normally required for the thin gage sheet metal which is used in the design.

Additionally, the close proximity of the ballast to the three walls transfers heat directly from the ballast to the housing to dramatically increase the surface area for cooling. Since this design solution is an integral part of the housing structure and produces an exceptionally resilient enclosure, it lends itself to very inexpensive, minimally sized packaging.

The top panel of the stamping incorporates a structural hanging system fitted with three holes. The design of the structural hanging system uses triple wall construction which extends the width of the housing to the bottom end panels for added strength and safety, and holds the housing together to aid in assembly. The three holes provide the customer with flexibility to allow the customer to aim the fixture off the vertical axis by varying the lengths of chain in the two outside holes. For a conventional hanging, the middle hole is used with a single chain, and the outside holes are available for an optional safety chain.

The second fold-up sheet metal stamping for the bottom housing member completes the design to form a rigid monocoque design. This stamping contains preformed sections to add strength to the design. The lamp socket is mounted to the bottom of the stamping with the wires thereto running under the ballast coil into the capacitor area. The capacitor is mounted to an end portion of the stamping by a metal strap and a hook and screw system. One end of a standard universal metal strap is inserted into and hooked into a recessed lock, and the other end of the strap is screwed through a recessed hole chamber which prevents the screw head from protruding past the panel surface. This system accommodates a number of different size and type capacitors. Oil type capacitors are prevented from moving by horizontal ribs. If a starter is required, it is strapped and ganged along with the capacitor by the metal strap and screw. In some embodiments, the end panels of the stamping can have an offset center tab at the top to trap the hanger panels in place. The tabs prevent the hanger panels from being pushed inwardly, and aid in the application of the four screws during assembly.

Vent holes are provided to strategically circulate air through the unit, in addition to heat sinking the ballast to the housing and shielding the starter and capacitor with an internal wall. Air flow is directed by gradated vent holes provided in the lower portion of the two end panels to draw air into the housing over the starter, capacitor and ballast. Gradated vent holes are also provided in the top portion of the front and rear panels for venting the hot air.

The housing concept provides a simple box, and the compact design thereof allows for an inexpensive reflector mounting solution. A luminaire reflector can be easily attached to and adjusted up or down with single vertical brackets over the front and rear panels of the housing. This system is superior to frequently used direct mount spacer systems because it allows customer flexibility, easy installation, and adjustments for different distribution patterns. The box configuration also permits a single piece bracket system as compared with a usual two piece design. This mounting arrangement also provides thermal advantages as it provides a large open gap for circulating and venting hot air from the reflector and lamp.

Input power is provided by a prewired cord which extends through one of the top hanger panels over the capacitor area. An electrical conduit could be substituted for the prewired cord with a minor hole change. The capacitor and starter can be replaced, or field supply connections can be made by removing two top screws and hinging down the capacitor end panel. Ballast replacement is not economically viable due to the product pricing structure, and was not considered as a design parameter. However, it could be accomplished by disassembling and un-folding the top housing.

Figure 4:
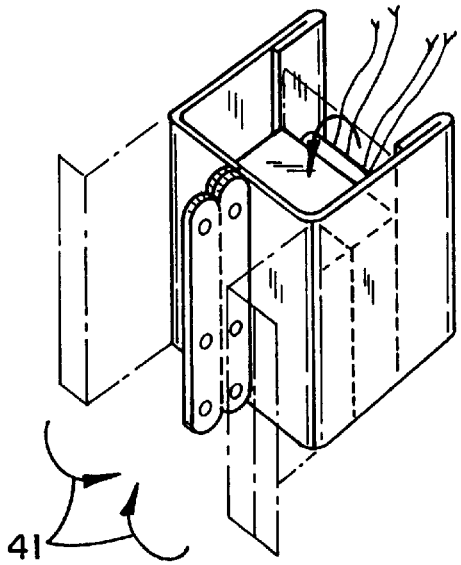
FIG. 4 illustrates how the ends of the stamping are folded inwardly by 90° to join at the center top of the top housing.
Figure 5:
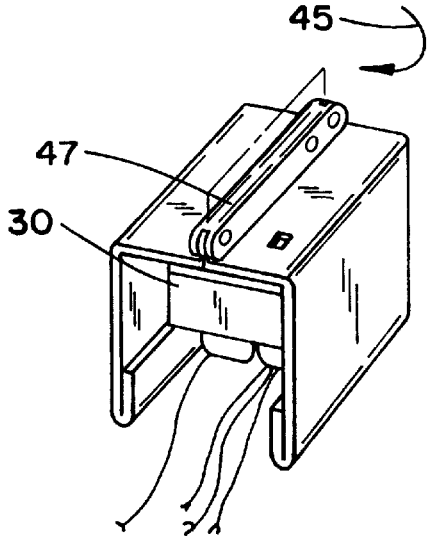
FIG. 5 illustrates how the very end of the second end is folded back 180° upon itself while encompassing the first end of the top stamping to form a triple wall hanging system.
Figure 6:
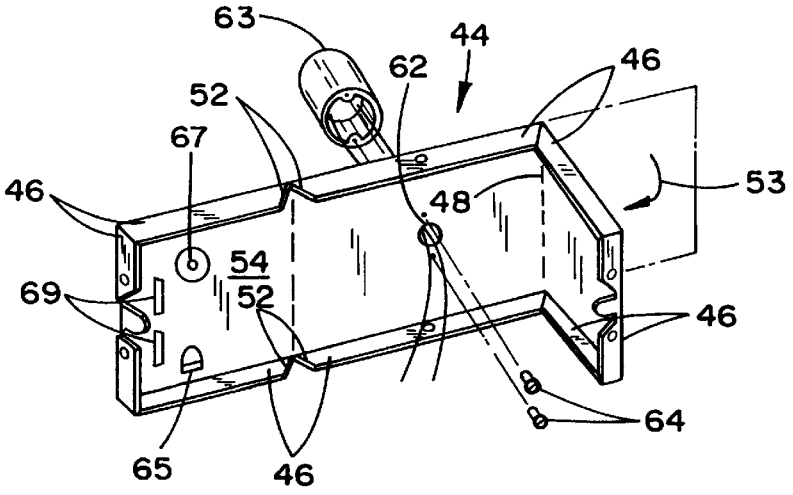
FIG. 6 illustrates the bottom sheet metal stamping wherein the edges of the bottom sheet metal stamping are folded 90° relative to the main body of the bottom stamping, and a first end of the bottom stamping is bent inwardly 90°.
Figure 7:
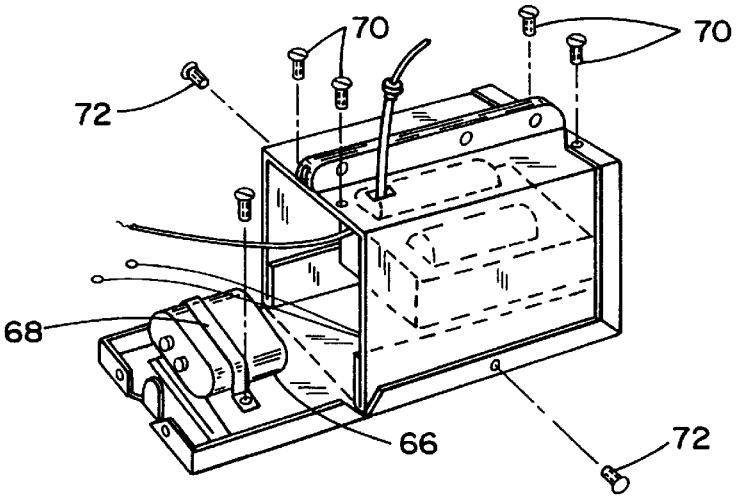
FIG. 7 illustrates the assembly of the top and bottom housing members, and also the placement of a capacitor on a capacitor panel on the bottom housing member.
Figure 8:
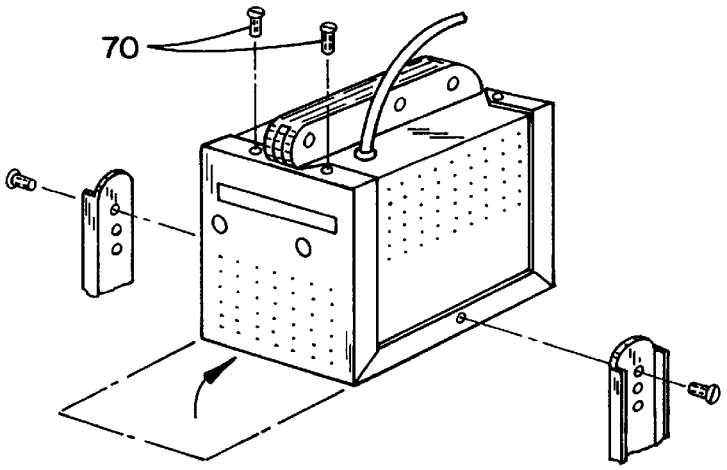
FIG. 8 illustrates the assembly of the top housing with the bottom housing.

FIGS. 1–5 illustrate the assembly sequence of the top perforation-scored fold-up stamping to form a top housing, while FIGS. 6–8 illustrate the assembly sequence of the bottom perforation-scored fold-up stamping to form a bottom housing, and its assembly with the top housing.

Figure 1:
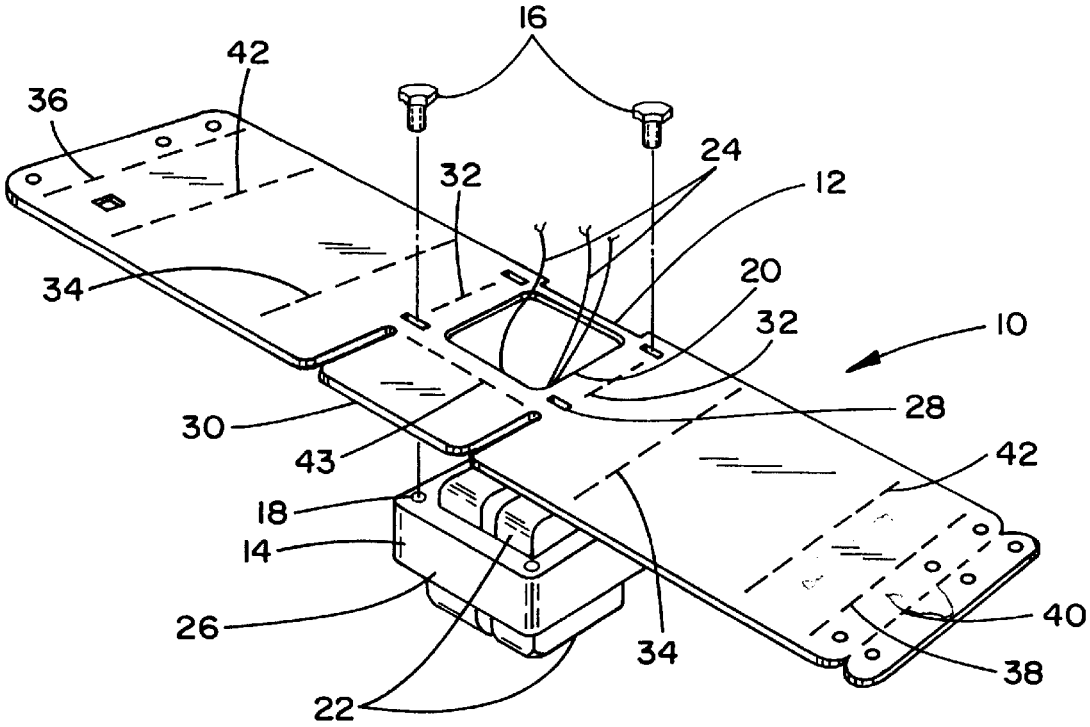
FIG. 1 illustrates the top sheet metal stamping in an initial stamped state.

FIG. 1 illustrates the top stamping 10 in an initial stamped state. The top stamping defines a central ballast shelf 12 on which the ballast 14 is mounted by mounting bolts 16 which extend through holes in the central ballast shelf and into mounting holes 18 in the core of the ballast. The central ballast shelf also defines a central ballast mounting hole 20 which allows the coils 22 of the ballast to project therethrough, along with wire leads 24 to the ballast, to allow the ballast core 26 to rest directly against the central ballast shelf 12. Special mounting holes 28 are also provided in the central ballast shelf to provide clearance for bolt heads which extend from the ballast core into the ballast mounting shelf. A heat shield 30 is formed along one end of the central ballast shelf, which is subsequently folded 90°0 relative to the central ballast shelf to form a heat shield between the hot ballast and the starter and capacitor, as illustrated in FIGS. 9 and 10.

Figure 2:
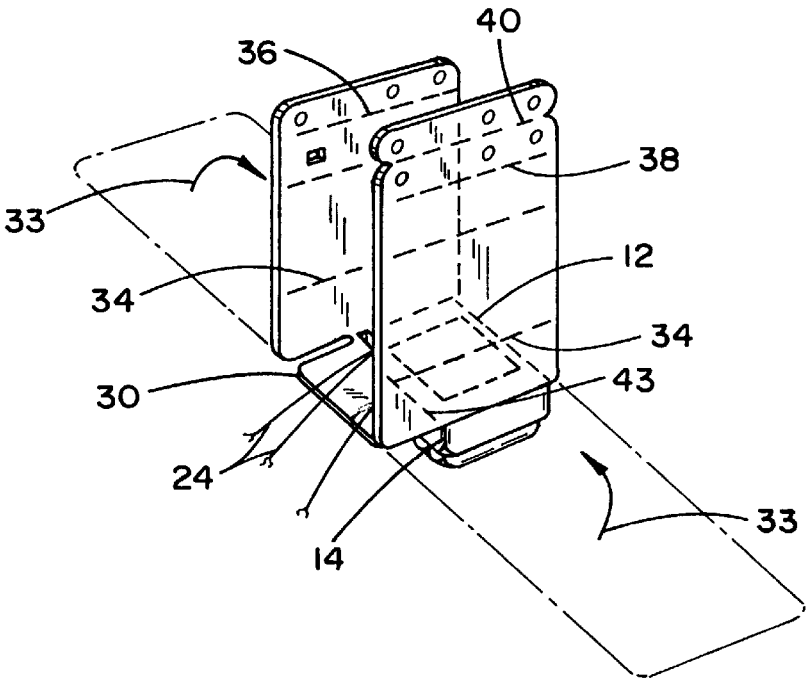
FIG. 2 illustrates how first and second ends of the top stamping are bent on opposite sides of a central ballast shelf.

The top stamping 10 includes two sets of perforation scores 32 on opposite sides of the central ballast shelf 12, about which both ends of the stamping are bent or folded 90°, as illustrated by arrows 33 in FIG. 2.

Figure 3:
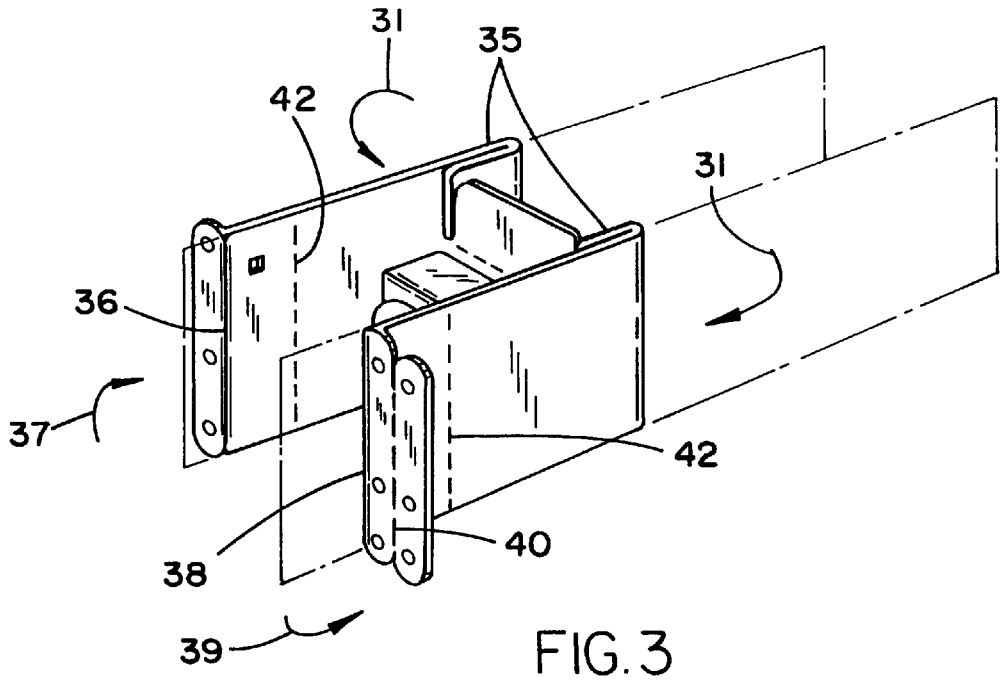
FIG. 3 illustrates how the ends of the stamping are folded back 180° upon themselves to form a double wall, fold-back mounting system.

A second set of perforation scores 34 is provided in the top stamping 10 which allows the ends of the stamping to then be folded back 180° upon themselves, as illustrated by arrows 31 in FIGS. 2 and 3, to form a double wall fold-back mounting system 35 as illustrated in FIG. 3.

One end of the top stamping 10 defines a single perforation score line 36, about which the end is folded or bent 90 degrees outwardly, as illustrated by arrow 37 in FIG. 3. The other end of the top stamping 10 defines a pair of inner 38 and outer 40 spaced perforation score lines. The inner score line 38 allows the second end of the top stamping to be bent outwardly 90 degrees, as illustrated by arrow 39 in FIG. 3.

A further set of perforation score lines 42 allow the ends of the top stamping 10 to be bent inwardly 90° over the mounted ballast, as illustrated by arrows 41 in FIG. 4.

FIG. 5 illustrates the heat shield 30 being folded 90° about fold line 43 to a position directly adjacent to the ballast, to form a heat shield between the ballast 14 and a subsequently mounted capacitor 66 and starter (if required), as shown in FIG. 7.

The outer score line 40 on the second end of the top stamping allows the very end of the second end to be folded back 180° upon itself, such that it folds over and encompasses the very end of the first end of the top stamping, as illustrated by arrow 45 in FIG. 5, to form a triple wall hanging system 47.

FIG. 6 illustrates the bottom sheet metal stamping 44 which is defined with a number of perforation score lines, including a set of score lines 46 spaced just inside the outer perimeter of the bottom sheet metal stamping which allow the edges of the bottom sheet metal stamping to be folded 90 degrees relative to the main body of the bottom stamping 44.

A perforation score line 48 across the width of a first end of the bottom stamping, along with V notches defined on opposite edges of the bottom stamping, similar to the V notches 52 illustrated in FIG. 6, enable the first end of the bottom stamping to be bent inwardly 90 degrees, as illustrated by arrow 53 in FIG. 6.

The second end of the bottom stamping forms a capacitor mounting panel 54.

The middle of the bottom stamping is provided with a mounting hole 62 for a lamp socket 63, which is secured extending downwardly from the bottom stamping by threaded fasteners 64 which extend through holes in the bottom stamping into the lamp socket 63.

A capacitor 66 is mounted to the capacitor panel 54 with a mounting strap 68 which has a tab at a first end which is inserted into a slot 65 with a stop to prevent the strap from sliding out, and a screw fastener at a second end which engages a screw holes 67, with the mounting strap extending around and securing a capacitor in place, as illustrated in FIG. 7. Raised capacitor stops 69 assist in securing the capacitor in place.

The top housing as formed in FIG. 5 is then assembled with the bottom housing as formed in FIG. 6 to complete one housing, as illustrated in FIG. 7, and secured thereto with 4 screws 70. Two side screws 72 are also used to secure three position reflector brackets 74 (which mount a reflector for the luminaire) to the assembled housing, and extend through the reflector bracket, through the single wall at the side of the top housing member, and then through the bottom double wall of the top housing member, securing all of those elements together as one thick wall, as shown in FIG. 8. The reflector brackets are provided with a multiple (e.g. 3 or 4) hole positioning system to provide for variable positioning of the reflector with respect to the assembled housing. A strain relief and cord 76 extends through a grommet 78 in the top housing, as illustrated in FIGS. 7 and 8.

FIGS. 9 and 10 illustrate the assembled housing, and show the ballast and the capacitor being mounted in a separate compartment 80 which is separated from the ballast 14 by the heat shield 30. The offset mounted ballast 14 is mounted closely adjacent to the upper housing walls on three sides of the ballast core. The top of the assembled housing defines a triple wall construction 47 to securely mount the assembled housing to a supporting structure. The special mounting holes 28 in the upper housing allow fastener heads to extend through the inside walls to mount the ballast closer to the outside walls. A wireway 82 is defined extending underneath the mounted ballast.

In one alternative embodiment, the ballast can be positioned centrally with respect to the top housing on a centrally positioned ballast mounting shelf. Two heat shields can be provided on opposite sides of the centrally positioned ballast mounting shelf, to create first and second compartments on opposite sides of the centrally mounted ballast, with one of the compartments being for a capacitor and the second of the compartments being for options, such as hot restrike, fusing, etc.

While several embodiments and variations of the present invention for a sheet metal housing for an HID luminaire are described in detail herein, it should be apparent that the disclosure and teachings of the present invention will suggest many alternative designs to those skilled in the art.

What is claimed is:

1. A two piece, fold-up sheet metal housing for a luminaire which provides strength with minimal usage of materials to support a heavy ballast comprising:

a. a top sheet metal stamping defining a central ballast shelf on which a ballast is mounted, wherein first and second ends of the top stamping are bent 90° on opposite sides of the central ballast shelf, and the first and second ends of the top stamping are further bent back 180° upon themselves to form a double wall, and the first and second ends of the top stamping are further bent 90° to project towards each other, and the very end of the first end of the top stamping is further bent 90° to form a first wall of a top wall hanging system, and the second end of the top stamping is further bent 90° to form a second wall of the top wall hanging system, and is further bent 180° while encompassing the first wall hanger to form a third wall of the top wall hanging system, to form a top sheet metal housing;

b. a bottom sheet metal stamping, wherein first and second ends of the bottom sheet metal stamping are bent 90° about a central section to form a bottom sheet metal housing which is secured to the top sheet metal housing to form an assembled sheet metal housing for the luminaire in a rigid monocoque design.

2. A two piece, fold-up housing as claimed in claim 1, wherein a heat shield is formed along one end of the central ballast shelf, which is bent 90° relative to the central ballast shelf to form a heat shield adjacent to the central ballast.

3. A two piece, fold-up housing as claimed in claim 2, wherein the heat shield separates the hot ballast from a capacitor, starter and wiring compartment.

4. A two piece, fold-up housing as claimed in claim 1, wherein the ballast is secured to the central ballast shelf by mounting fasteners which extend through holes in the central ballast shelf and into mounting holes in the core of the ballast, such that the rigidity of the ballast core reinforces the top housing.

5. A two piece, fold-up housing as claimed in claim 1, wherein the central ballast shelf defines a central ballast mounting hole which allows coils of the ballast to project therethrough, to allow the ballast core to rest directly against the central ballast shelf.

6. A two piece, fold-up housing as claimed in claim 1, wherein clearance holes are provided in the central ballast shelf to provide clearance for fastener heads which extend from the ballast into the mounting shelf.

7. A two piece, fold-up housing as claimed in claim 1, wherein the ballast shelf is mounted with a wireway duct being defined below the mounted ballast.

8. A two piece, fold-up housing as claimed in claim 1, wherein the ballast is mounted offset in the top sheet metal housing with the ballast steel core in close proximity to three sides of the upper housing, such that the close proximity of the ballast to the three walls transfers heat directly from the ballast to the housing to increase the surface area for cooling.

9. A two piece, fold-up housing as claimed in claim 1, wherein vent holes are provided in a lower portion of two end panels of the bottom housing to draw air into the housing over the capacitor and ballast, and vent holes are also provided in a top portion of front and rear panels of the top housing for venting the hot air.

10. A two piece, fold-up housing as claimed in claim 1, wherein a lamp socket is mounted to the bottom housing with the wires thereto running under the ballast coil into a capacitor compartment.

11. A two piece, fold-up housing as claimed in claim 1, wherein a capacitor is mounted on a capacitor end panel of the bottom housing.

12. A two piece, fold-up housing as claimed in claim 11, wherein the capacitor is mounted to the capacitor panel by a metal strap, wherein a first end of the metal strap is inserted into and secured in a recess, and a second end of the strap is secured by a screw to a hole in the capacitor panel.

* * * * *